US009125456B2

(12) United States Patent
Chow

(10) Patent No.: US 9,125,456 B2
(45) Date of Patent: Sep. 8, 2015

(54) OBJECT-CONTAINING BUTTON

(71) Applicant: Chong Sun Chow, Hong Kong (HK)

(72) Inventor: Chong Sun Chow, Hong Kong (HK)

( * ) Notice: Subject to any disclaimer, the term of this patent is extended or adjusted under 35 U.S.C. 154(b) by 173 days.

(21) Appl. No.: 13/655,481

(22) Filed: Oct. 19, 2012

(65) Prior Publication Data

US 2013/0247335 A1 Sep. 26, 2013

Related U.S. Application Data

(60) Provisional application No. 61/615,365, filed on Mar. 26, 2012.

(51) Int. Cl.

| | |
|---|---|
| ***A44B 1/08*** | (2006.01) |
| ***A44B 1/06*** | (2006.01) |
| *A44B 1/04* | (2006.01) |

(52) U.S. Cl.

CPC ... *A44B 1/08* (2013.01); *A44B 1/06* (2013.01); *A44B 1/04* (2013.01); *Y10T 24/1382* (2015.01); *Y10T 24/36* (2015.01); *Y10T 24/3694* (2015.01)

(58) Field of Classification Search

CPC ..... A44B 1/08; A44B 1/06; Y10T 24/1382
USPC ..... 24/3.7, 90.1, 103, 104, 105, 113 R, 24/113 MP, 114.7; 206/222; 224/182, 587, 224/163, 197, 199

See application file for complete search history.

(56) References Cited

U.S. PATENT DOCUMENTS

| | | | | |
|---|---|---|---|---|
| 3,596,329 | A * | 8/1971 | Hoban | 24/114.7 |
| 5,033,168 | A * | 7/1991 | Sbragi | 24/113 MP |
| 2002/0066747 | A1* | 6/2002 | Argentieri et al. | 222/81 |
| 2005/0082194 | A1* | 4/2005 | Fry et al. | 206/531 |
| 2007/0023299 | A1* | 2/2007 | Clarkson | 206/219 |
| 2008/0179334 | A1* | 7/2008 | Abramson et al. | 220/568 |
| 2008/0244873 | A1* | 10/2008 | Yamashita et al. | 24/90.1 |
| 2009/0020495 | A1* | 1/2009 | Cheng | 215/316 |
| 2009/0216213 | A1* | 8/2009 | Muir et al. | 604/414 |
| 2013/0025691 | A1* | 1/2013 | Muir et al. | 137/1 |
| 2014/0211829 | A1* | 7/2014 | Nichols | 374/159 |

* cited by examiner

*Primary Examiner* — Robert J Sandy
*Assistant Examiner* — Michael Lee

(57) ABSTRACT

An object-containing button includes a housing and upper and lower floors mounted within the housing. Each floor has a plurality of thread-receiving holes and two pin holes formed at opposite side of the thread-receiving holes. A container rotatably and detachably coupled to the housing. An object is stored inside the container. A removable lid covers a bottom opening of the container facing the upper floor. A pin-carrying member having two pins inserted through the pin holes for piercing and tearing open the cover.

20 Claims, 8 Drawing Sheets

OBJECT-CONTAINING BUTTON

CROSS-REFERENCE TO RELATED APPLICATIONS

This application claims priority of U.S. provisional patent application No. 61/615,365 filed on Mar. 26, 2012, the entire content of which is hereby incorporated by reference.

FIELD OF THE TECHNOLOGY

The present application relates to a button and particularly to an object-containing button.

BACKGROUND

Conventional buttons are used for articles of apparel or other accessories and trimmings. These buttons are commonly used in cooperation with button holes to perform a sole function of fastening by simply inserting the buttons through respective button holes. Some of these buttons are provided with specially designed front faces for decoration purposes. However, the functions of these conventional buttons are limiting.

There is a need to produce an improved button that can store an object and release it or make use of it when needed.

The above description of the background is provided to aid in understanding a button, but is not admitted to describe or constitute pertinent prior art to the button disclosed in the present application, or consider any cited documents as material to the patentability of the claims of the present application.

SUMMARY

Although the button disclosed in the present application is shown and described with respect to certain embodiments, it is obvious that equivalents and modifications will occur to others skilled in the art upon the reading and understanding of the specification. The present application includes all such equivalents and modifications, and is limited only by the scope of the claims.

BRIEF DESCRIPTION OF THE DRAWINGS

Specific embodiments of the button disclosed in the present application will now be described by way of example with reference to the accompanying drawings wherein.

DETAILED DESCRIPTION

Figure 1:
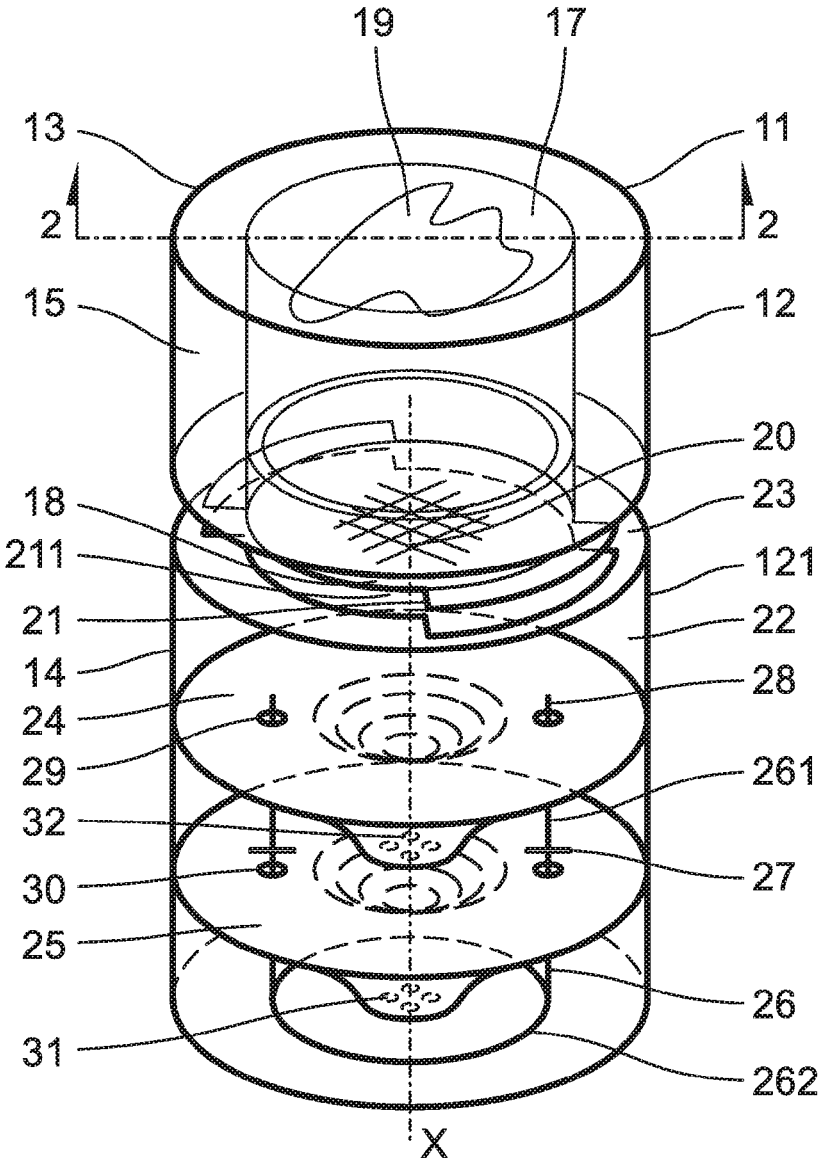
FIG. 1 is an exploded/perspective view of an object-containing button according to an embodiment of the present application.

Reference will now be made in detail to a preferred embodiment of the button disclosed in the present application, examples of which are also provided in the following description. Exemplary embodiments of the button disclosed in the present application are described in detail, although it will be apparent to those skilled in the relevant art that some features that are not particularly important to an understanding of the button may not be shown for the sake of clarity.

Furthermore, it should be understood that the button disclosed in the present application is not limited to the precise embodiments described below and that various changes and modifications thereof may be effected by one skilled in the art without departing from the spirit or scope of the appended claims. For example, elements and/or features of different illustrative embodiments may be combined with each other and/or substituted for each other within the scope of this disclosure and appended claims.

Certain terminology is used in the following description for convenience only and is not limiting. The words "upper", "lower", "top", and "bottom" designate directions in the drawings to which reference is made. The terminology includes the words noted above as well as derivatives thereof and words of similar import.

It should be noted that throughout the specification and claims herein, when one element is said to be "coupled" or "connected" to another, this does not necessarily mean that one element is fastened, secured, or otherwise attached to another element. Instead, the term "coupled" or "connected" means that one element is either connected directly or indirectly to another element, or is in mechanical or electrical communication with another element.

FIG. 1 is an exploded/perspective view of an object-containing button 11 according to an embodiment of the present application. The object-containing button 11 may include a container 13 detachably mounted on top of a bottom housing 14. The housing 14 may include a central cylindrical bore 22 extending therethrough and defining a central axis X. Upper and lower floors 24, 25 can be mounted across the bore 22 and spaced axially apart from each other.

The upper floor 24 may have a plurality of thread-receiving holes 32 formed at a central portion thereof and two pin holes 29 formed at opposite sides of the thread-receiving holes 32. Similarly, the lower floor 25 may have a plurality of thread-receiving holes 31 formed at a central portion thereof and two pin holes 30 formed at opposite sides of the thread-receiving holes 31. The thread-receiving holes 32 and the pin holes 29 of the upper floor 24 are in alignment with the thread-receiving holes 31 and the pin holes 30 of the lower floor 25 respectively. Each of the upper and lower floors 24, 25 may have two or four thread-receiving holes 32, 31 as provided on a conventional button.

The container 13 may include a cavity 17 for receiving therein an object 19. The container 13 may have a bottom opening 16 facing the upper floor 24 of the housing 14. The container 13 can rotate about the central axis X and detachably coupled to the housing 14.

The housing 14, upper and lower floors 24, 25 and the container 13 may be made of the same material as a conventional button such as plastic or other suitable material.

A lid or cover 20 can be used to cover the bottom opening 16 of the container 13. The cover 20 may be made of a material selected from the group consisting of polyvinyl chloride tubing, polyolefin tubing, polyurethane, polypropylene, aluminum and polyester. The cover 20 can be secured to a bottom portion of the container 13 by a method selected from the group consisting of adhering, melting, welding, heat-shrinking, non heat-shrinking, dry blending and coatings treatment.

Figure 2A:
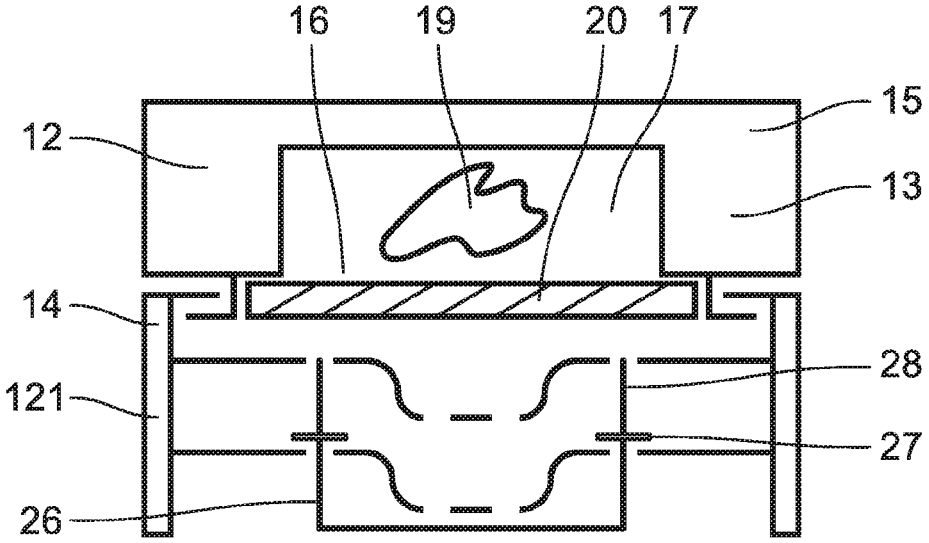
FIG. 2A is a cross sectional view of the object-containing button of FIG. 1.

FIG. 2A is a cross sectional view of the object-containing button 11 according to an embodiment of the present application. In this embodiment, the container 13 may have a cylindrical sidewall 15 with a cylindrical outer surface 12. The housing 14 may also have a cylindrical sidewall with a cylindrical outer surface 121. The container 13 and the housing 14 when attached together can form a cylindrical object-containing button 11.

Figure 2B:
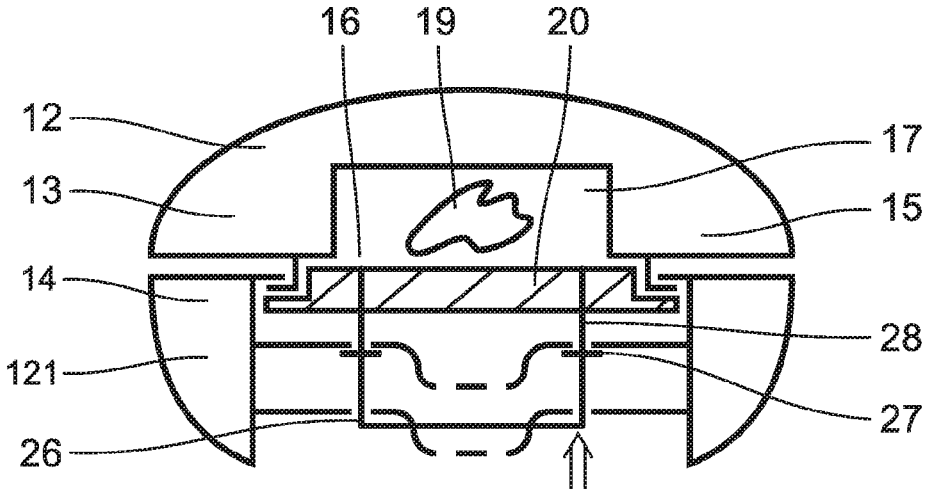
FIG. 2B is a cross sectional view of a round-shaped object-containing button.

FIG. 2B is a cross sectional view of the object-containing button 11 according to another embodiment of the present application. In this embodiment shown, the object-containing button 11 can have curved surfaces. It is understood that the object-containing button 11 can be in the shape of any conventional buttons or in any other possible shapes such as rectangular, square, spherical, oval or dome-shaped.

Figure 3:
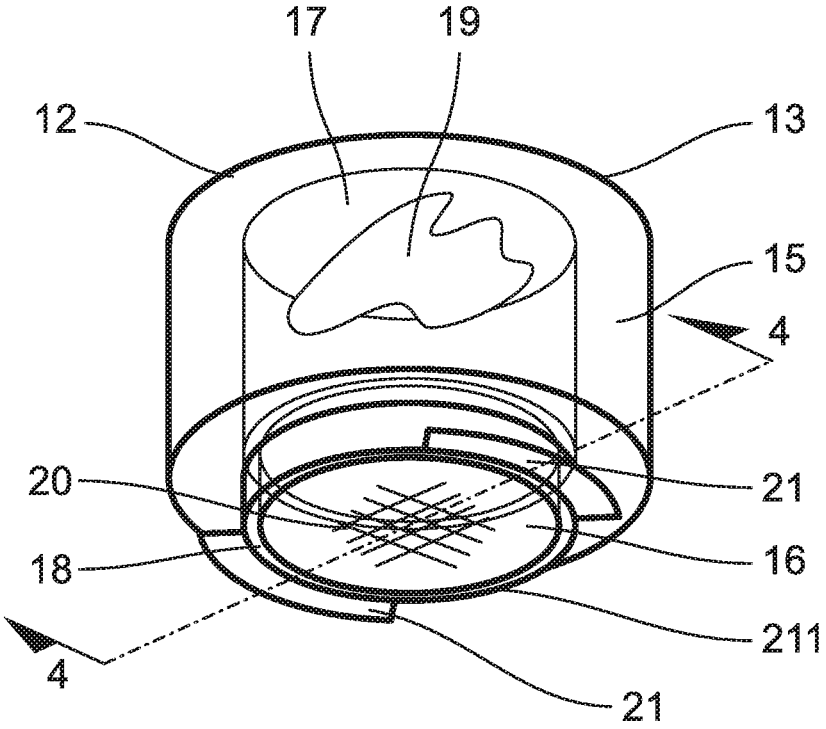
FIG. 3 is a bottom perspective view of a container.

FIG. 3 is a bottom perspective view of the container 13. It can be seen that the bottom surface of the container 13 can be provided with an annular skirt 18 around the bottom opening 16 and two opposite out-turned flanges 21 projecting radially outwardly from at a lower edge of the annular skirt 18. The annular skirt 18 and the bottom surface of the container 13 together define an annular recess 181 in which the cover 20 can be mounted.

The housing 14 can be provided with two opposite in-turned flanges 23 projecting radially inwardly from an annular upper edge of the housing 14. The two opposite in-turned flanges 23 may have dimensions slightly less than those of two opposite slots 211 extending between the two opposite out-turned flanges 21 so that the two opposite in-turned flanges 23 are adapted to pass axially through the two opposite slots 211 and rotatable within an annular channel 182 defined by the bottom surface of the container 13, the annular skirt 18 and the two opposite out-turned flanges 21.

Figure 4A:
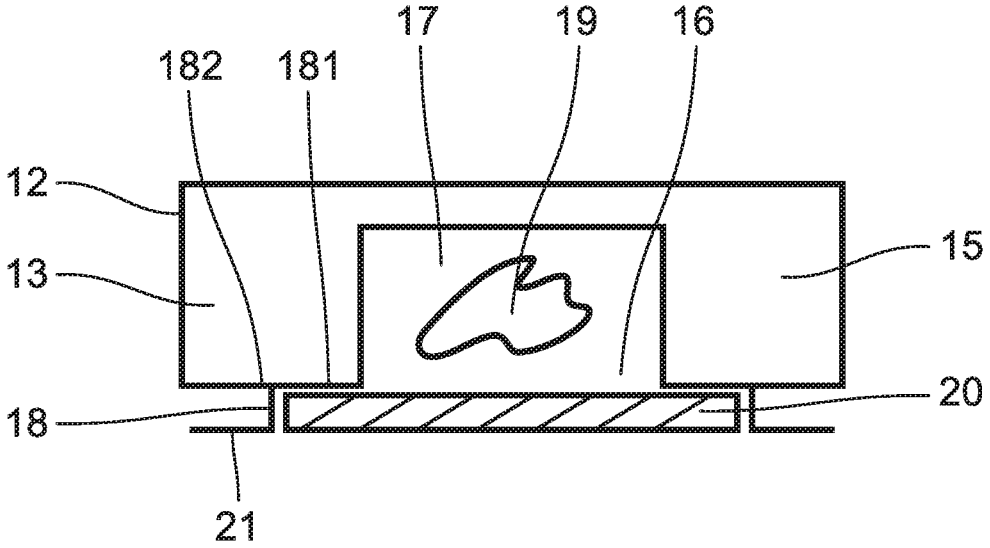
FIG. 4A is a cross sectional view of the container with a cover according to an embodiment of the present application.

FIG. 4A is a cross sectional view of the container 13 with the cover 20 according to a first embodiment of the present application. According to the first embodiment, the cover 20 can be in the form of a disk. The disk is circular in shape, as best illustrated in FIG. 4C. The cover 20 can have a diameter slightly less than the diameter of the annular recess 181 so that the cover 20 can fit within the annular recess 181. When the cover 20 is secured within the annular recess 181, the cover 20 can entirely cover the bottom opening 16 of the container 13.

Figure 4B:
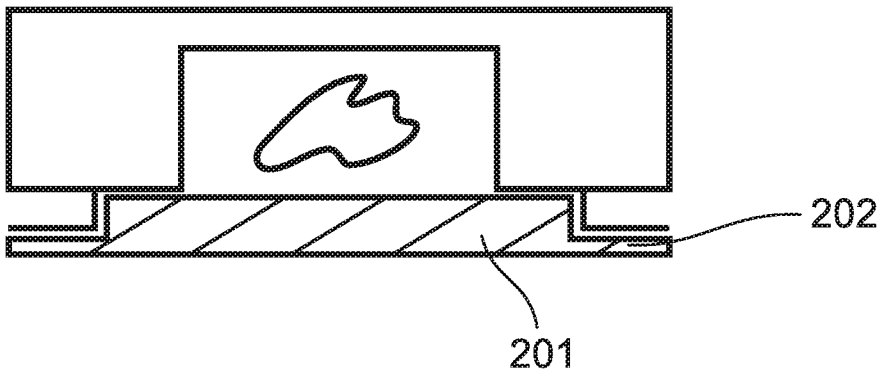
FIG. 4B is a cross sectional view of the container with a cover according to another embodiment of the present application.
Figure 4C:
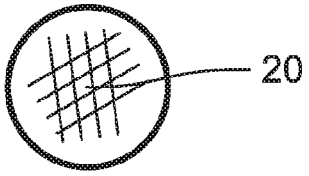
FIG. 4C is a top plan view of the cover of FIG. 4A.
Figure 4D:
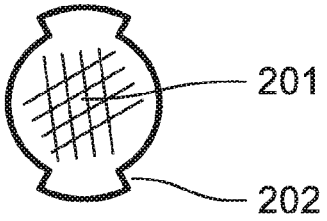
FIG. 4D is a top plan view of the cover of FIG. 4B.

FIG. 4B is a cross sectional view of the container 13 with a different cover 201 according to a second embodiment of the present application. According to the second embodiment, the cover 201 can be in the form of a disk with two opposite radially outwardly projecting tabs 202. A plan view of the cover 201 is shown in FIG. 4D. The two opposite radially outwardly projecting tabs 202 may have the same shape as the two opposite out-turned flanges 21 provided on the annular skirt 18. When the cover 201 is secured within the annular recess 181, the two opposite radially outwardly projecting tabs 202 can be superimposed on the two opposite out-turned flanges 21 on the annular skirt 18.

Figure 5:
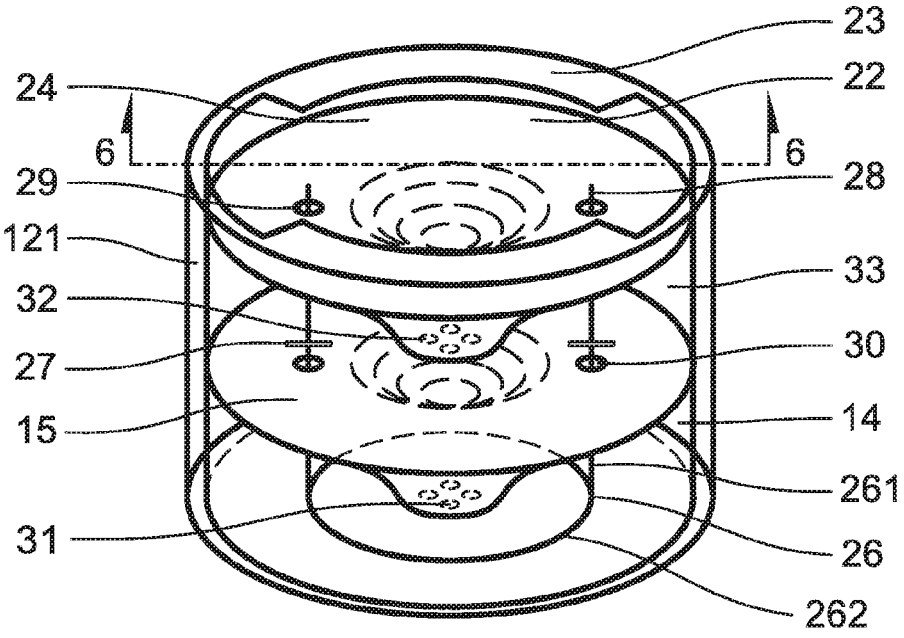
FIG. 5 is an exploded/perspective view of a bottom housing according to an embodiment of the present application.
Figure 6:
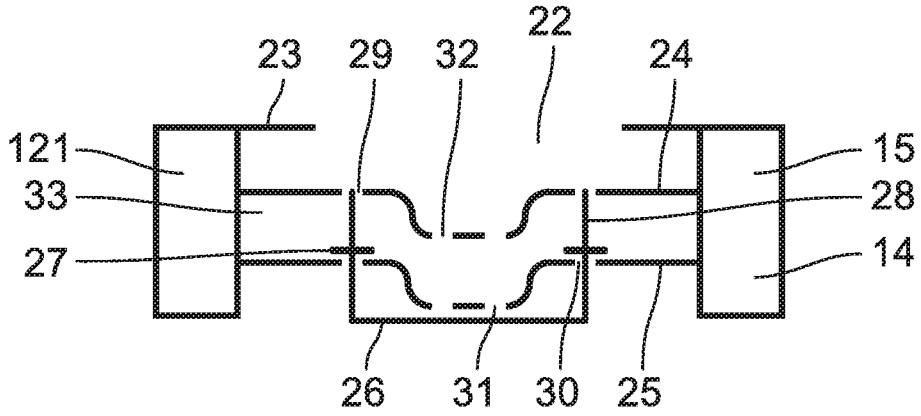
FIG. 6 is a cross sectional view of the bottom housing.

FIGS. 5 and 6 are two different views of the housing 14 according to an embodiment of the present application. The upper and lower floors 24, 25 are spaced apart from each other to define a space 33 thereinbetween. Each of the upper and lower floors 24, 25 may be in the shape of a trumpet with a flaring end facing the container 13.

Figure 9:
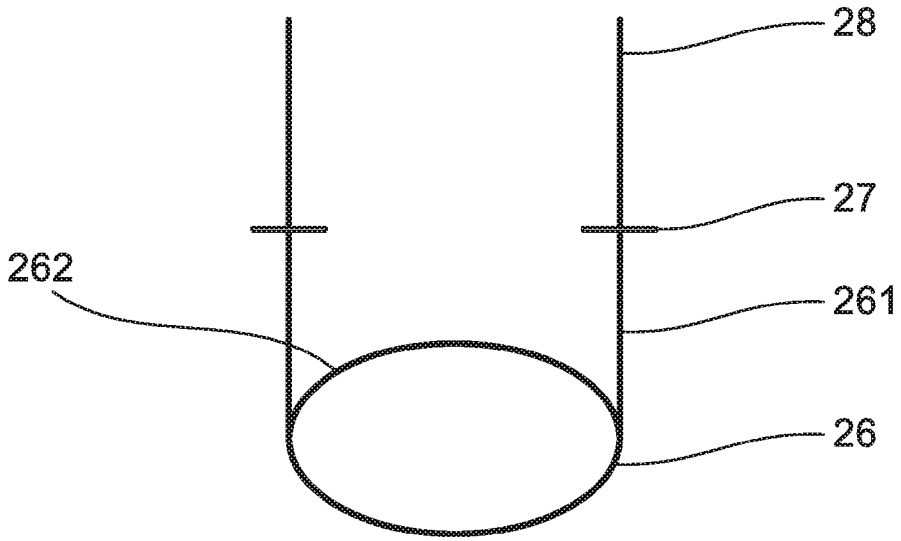
FIG. 9 is a pin-carrying member according to an embodiment of the present application.

The housing 14 may further include a pin-carrying member 26 (FIG. 9) having two pins 261 connected to a pin head 262. The pin head 262 can be in the form of a ring. The two pins 261 can be inserted through the aligned pin holes 29, 30 of the upper and lower floors 24, 25. The two pins 261 have two pointing ends 28 disposed at the upper floor 24, and two lower ends connected to the ring member 262 disposed underneath the lower floor 25. The pin-carrying member 26 can be moveable from a first position where the two upper pointing ends 28 are out of contact with the cover 20, 201 and a second position where the two upper pointing ends 28 are piercing through the cover 20, 201.

The pin-carrying member 26 may further include a stop member 27 provided transversely on each of the two pins 261 of the pin-carrying member 26 between the upper and lower floors 24, 25 for limiting the movement of the pin-carrying member 26 between the first and second positions. It is understood that the dimensions of the stop members 27 are larger than that of the pin holes 29, 30 of the upper and lower floors 24, 25 such that the stop members 27 can only be moveable within the space 33 between the upper and lower floors 24, 25. The pin-carrying member 26 may be made of metal wires or other suitable material.

Figure 7:
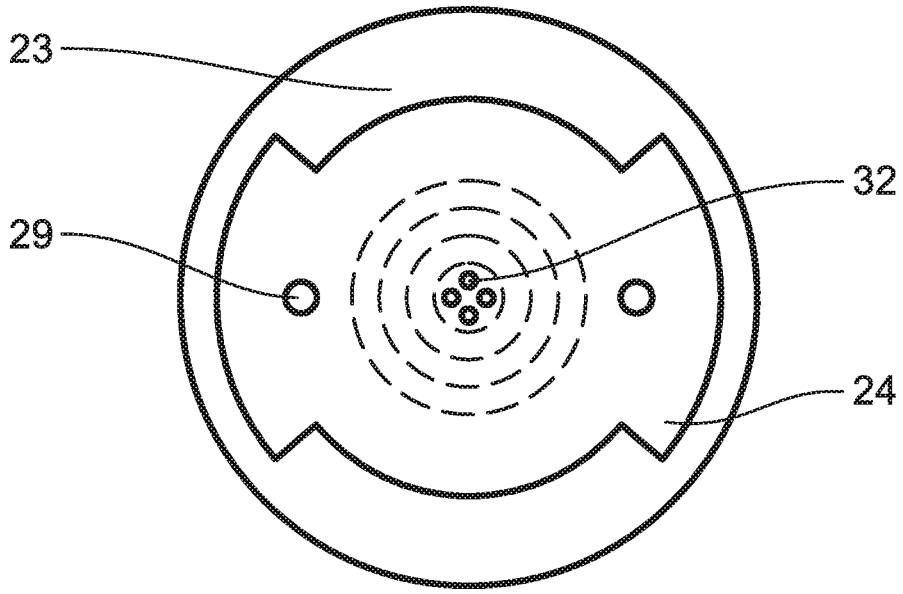
FIG. 7 is a top plan view of the bottom housing and an upper floor provided therein.
Figure 8:
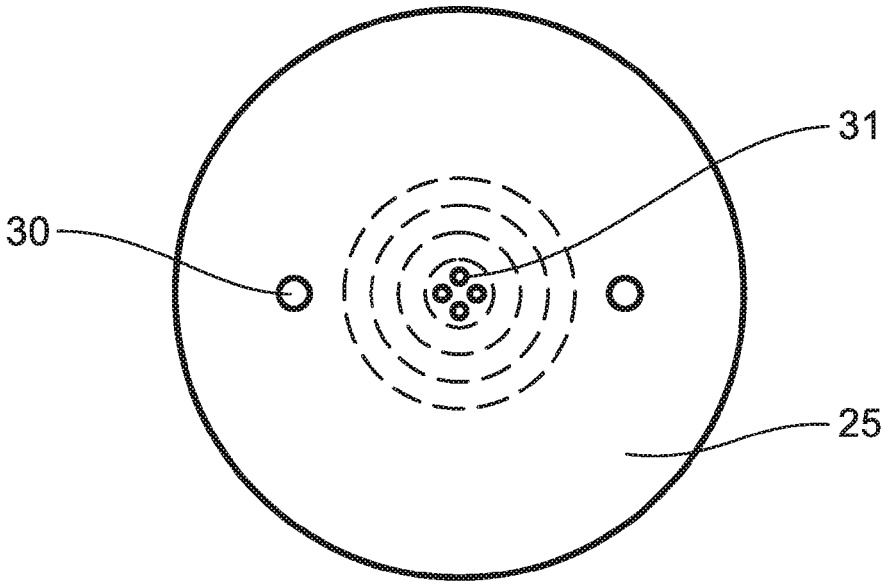
FIG. 8 is a top plan view of a lower floor of the bottom housing.

FIG. 7 is a top plan view of the housing 14 showing the upper floor 24 provided therein, and the two opposite in-turned flanges 23. FIG. 8 is a top plan view of the lower floor 25 of the housing 14. It can be seen that the pin holes 29, 30 can be formed close to the sidewall of the housing 14.

Although it has been shown and described that there are two pins 261 inserted through two opposite pin holes 29, 30 formed on each of the upper and lower floors 24, 25, it is understood by one skilled in the art that the pin-carrying member 26 may be provided with only one pin 261 inserted through only one pin hole 29, 30 formed on each of the upper and lower floors 24, 25.

Although it has been shown and described that the container 13 is coupled to the housing 14 by the engagement of opposite out-turned and in-turned flanges 21, 23, it is contemplated that the coupling of the container 13 to the housing 14 can be achieved by other means such as snap fastening and screw threading, etc.

Figure 10:
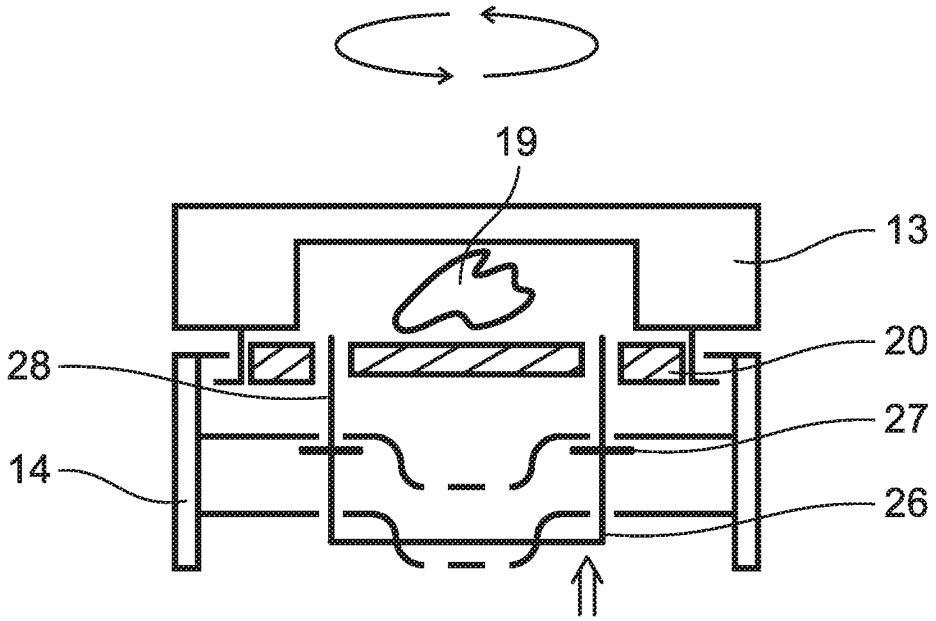
FIG. 10 is an illustrative diagram showing the operation of the object-containing button of the present application.

FIG. 10 is an illustrative diagram showing the operation of the object-containing button 11 of the present application. The object-containing button 11 can allow a user to quickly release the object 19 stored inside the container 13 by hands.

One way is to simply rotate the container 13 and pull it away from the housing 14 so that the two opposite out-turned flanges 21 of the container 13 are disengaged from the two opposite in-turned flanges 23 of the housing 14. Thereafter, the user can remove the cover 20, 201 by hand and release the object 19 stored inside the container 13.

Another way is to push the pin-carrying member 26 up by one hand, as shown by the arrow in FIG. 10, so that the pin-carrying member 26 can move from the first position where the two upper pointing ends 28 of the two pins 261 are out of contact with the cover 20, 201 to a second position where the two upper pointing ends 28 of the two pins 261 are piercing through the cover 20, 201, as shown in FIG. 10. When the pin-carrying member 26 is pushed by one hand to the second position, the user can simultaneously rotate the container 13 using the other hand, as illustrated by the arrows in FIG. 10. When the container 13 is turned, the two upper pointing ends 28 can tear open the cover 20, 201 thereby allowing the release of the object 19 from the container 13.

The object-containing button 11 of the present application can be sewn onto articles of apparel or other accessories and trimmings such as beds, sport items, luggage, handbags, shoes, gloves, etc. This can be done in a conventional manner by threading threads through the thread-receiving holes 32, 31 formed on the upper and lower floors 24, 25

The object 19 stored inside the container 13 may be in a solid state, a liquid state, or even a gaseous state. For example, the object 19 stored inside the container 13 can be a perfume. A user can easily and conveniently generate a sweet/pleasant smell when needed. The object 19 stored inside the container 13 can be a medical pill. A user with a certain health issue can quickly take a pill in critical condition when medical treatment is not readily available. The object 19 inside the container 13 can include a smoke-generating material. A victim seeking for help in an accident can generate a smoke signal in order to attract the attention of helpers nearby.

Once the object 19 is released from the container 13, the used container 13 can be discarded. A new container 13 with an object 19 stored therein can be attached to the bottom housing 14 for future use.

While the button disclosed in the present application has been shown and described with particular references to a number of preferred embodiments thereof, it should be noted that various other changes or modifications may be made without departing from the scope of the appending claims.

What is claimed is:

1. An object-containing button comprising:

(a) a housing having a central cylindrical bore extending therethrough and defining a central axis;

(b) upper and lower floors mounted across the bore and spaced apart from each other, each floor having a plurality of thread-receiving holes formed at a central portion thereof and two pin holes formed at opposite sides of the thread-receiving holes, the thread-receiving holes and the pin holes of the upper floor being in alignment with the thread-receiving holes and the pin holes of the lower floor respectively;

(c) a container detachably coupled to the housing and rotatable about the central axis, the container having a cavity and a bottom opening facing the upper floor;

(d) an object stored in the cavity of the container;

(e) a cover covering the bottom opening of the container; and (f) a pin-carrying member having two pins inserted through the aligned pin holes of the upper and lower floors, the two pins having two upper pointing ends extending through the upper floor and two lower ends joined by a pin head disposed underneath the lower floor, the pin-carrying member being moveable axially from a first position where the two upper pointing ends are out of contact with the cover, and a second position where the two upper pointing ends are piercing through the cover; whereby rotation of the container with the pin-carrying member remaining at the second position drives the two upper pointing ends around thereby tearing open the cover.

2. The button as claimed in claim 1, wherein the container is provided with an annular skirt formed on a bottom surface thereof around the bottom opening and two opposite out-turned flanges projecting radially outwardly from a lower edge of the annular skirt, and the housing is provided with two opposite in-turned flanges projecting radially inwardly from an annular upper edge of the housing, and wherein the two opposite in-turned flanges have dimensions slightly less than those of two opposite slots extending between the two opposite out-turned flanges so that the two opposite in-turned flanges are adapted to pass axially through the two opposite slots and rotatable within an annular channel defined by the bottom surface of the container, the annular skirt and the two opposite out-turned flanges.

3. The button as claimed in claim 1, wherein the object is a perfume.

4. The button as claimed in claim 1, wherein the object is a medical pill.

5. The button as claimed in claim 1, wherein the object comprises smoke-producing material for producing a smoke signal.

6. An object-containing button comprising:

(a) a housing having a central cylindrical bore extending therethrough and defining a central axis;

(b) upper and lower floors mounted across the bore and spaced axially apart from each other, each floor having a plurality of thread-receiving holes formed at a central portion thereof, the thread-receiving holes of the upper floor being in alignment with the thread-receiving holes of the lower floor respectively;

(c) a container detachably coupled to the housing and rotatable about the central axis, the container having a cavity and a bottom opening facing the upper floor;

(d) an object stored in the cavity of the container; and (e) a cover covering the bottom opening of the container.

7. The button as claimed in claim 6, wherein each floor has at least one pin hole formed at one side of the thread-receiving holes and the at least one pin hole of the upper floor is in alignment with the at least one pin hole of the lower floor; wherein the housing comprises a pin-carrying member having at least one pin inserted through the at least one pin hole formed on the upper and lower floors, the at least one pin having at least one upper pointing end extending through the upper floor and at least one lower end connected to a pin head disposed underneath the lower floor, the pin-carrying member being moveable axially from a first position where the at least one upper pointing end is out of contact with the cover, and a second position where the at least one upper pointing end is piercing through the cover, whereby rotation of the container with the pin-carrying member remaining at the second position drives the at least one upper pointing end around thereby tearing open the cover.

8. The button as claimed in claim 7, further comprising at least one stop member provided transversely on the at least one pin of the pin-carrying member between the upper and lower floors for limiting the movement of the pin-carrying member between the first and second positions.

9. The button as claimed in claim 7, wherein each of the upper and lower floors has two pin holes formed at two opposite sides of the thread-receiving holes, and the pin-carrying member has two pins.

10. The button as claimed in claim 9, wherein the pin head is in the form of a ring.

11. The button as claimed in claim 6, wherein the container is provided with an annular skirt formed on a bottom surface thereof around the bottom opening and two opposite out-turned flanges projecting radially outwardly from a lower edge of the annular skirt, and wherein the housing is provided with two opposite in-turned flanges projecting radially inwardly from an annular upper edge of the housing for rotatable engagement within an annular channel defined by the bottom surface of the container, the annular skirt and the two opposite out-turned flanges.

12. The button as claimed in claim 6, wherein the cover is made of a material selected from the group consisting of polyvinyl chloride tubing, polyolefin tubing, polyurethane, polypropylene, aluminum and polyester.

13. The button as claimed in claim 6, wherein the cover is secured to a bottom surface of the container by a method selected from the group consisting of adhering, melting, welding, heat-shrinking, non heat-shrinking, dry blending and coatings treatment.

14. The button as claimed in claim 6, wherein the cover is circular in shape.

15. The button as claimed in claim 6, wherein the cover is circular in shape with two opposite tabs.

16. The button as claimed in claim 6, wherein each of the upper and lower floors is in the shape of a trumpet with a flaring end facing the container.

17. The button as claimed in claim 6, wherein the object is a perfume.

18. The button as claimed in claim 6, wherein the object is a medical pill.

19. The button as claimed in claim 6, wherein the object comprises smoke-producing material for producing a smoke signal.

20. The button as claimed in claim 6, wherein the housing and the container are cylindrical in shape.

* * * * *